US005941445A

United States Patent [19]

Nestler

[11] Patent Number: 5,941,445

[45] Date of Patent: Aug. 24, 1999

[54] APPARATUS FOR REFURBISHING A COKE OVEN DOORJAMB

[75] Inventor: Alvin M. Nestler, Hellertown, Pa.

[73] Assignee: Bethlehem Steel Corporation

[21] Appl. No.: 08/976,985

[22] Filed: Nov. 24, 1997

[51] Int. Cl.[6] ..... C10B 43/00

[52] U.S. Cl. ..... 228/119; 202/81; 202/241; 202/242; 202/248

[58] Field of Search ..... 228/119; 202/81, 202/241, 242, 248

[56] References Cited

U.S. PATENT DOCUMENTS

| | | | |
|---|---|---|---|
| 3,577,321 | 5/1971 | Schaten | 202/241 |
| 3,633,233 | 1/1972 | McCullough | 15/93 |
| 3,660,859 | 5/1972 | McCullough | 202/241 |
| 3,681,201 | 8/1972 | McCullough | 202/241 |
| 3,696,004 | 10/1972 | McCullough | 202/241 |
| 3,822,191 | 7/1974 | Konno | 202/241 |
| 3,847,753 | 11/1974 | Baird et al. | 202/241 |
| 3,955,232 | 5/1976 | Konno | 202/241 |
| 3,971,092 | 7/1976 | Stanke et al. | 202/241 |
| 4,000,043 | 12/1976 | Irwin | 202/241 |
| 4,025,979 | 5/1977 | Stanke et al. | 15/93 |
| 4,201,630 | 5/1980 | Hyde | 134/181 |
| 4,259,760 | 4/1981 | Harris | 202/241 |
| 4,300,257 | 11/1981 | Ibe et al. | 202/241 |
| 4,340,987 | 7/1982 | Gregor et al. | 15/93 |
| 4,375,389 | 3/1983 | Lindgren | 202/241 |
| 4,863,569 | 9/1989 | Marin et al. | 202/241 |
| 4,990,221 | 2/1991 | Baird et al. | 202/241 |

FOREIGN PATENT DOCUMENTS

| | | |
|---|---|---|
| 2022692 | 11/1970 | Germany . |
| 62-272285 | 4/1987 | Japan . |
| 193392 | 11/1989 | Japan . |
| 007393 | 4/1992 | Japan . |
| 092563 | 8/1996 | Japan . |
| 2176564 | 12/1986 | United Kingdom . |

OTHER PUBLICATIONS

International Search Report PCT/US98/14512, Mailed Oct. 22, 1998.

*Primary Examiner*—Patrick Ryan
*Assistant Examiner*—M. Alexandra Elve
*Attorney, Agent, or Firm*—Harold I. Masteller, Jr.

[57] ABSTRACT

A method and apparatus for refurbishing eroded portions in coke oven doorjambs including refurbishing apparatus having a framework attached to the coke oven structure adjacent the doorjamb. The framework supports a carriage that is simultaneously moveable in an "X" axis direction and a "Y" axis direction within the boundary so that a machine-cutting tool, attached to the carriage, can be moved from one position directly to another position within the framework boundary. The machine-cutting tool is positioned to make cutting passes alone new metal that is fused into the eroded portions of the coke oven doorjamb.

9 Claims, 5 Drawing Sheets

APPARATUS FOR REFURBISHING A COKE OVEN DOORJAMB

BACKGROUND OF THE INVENTION

This invention is directed to apparatus for refurbishing a coke oven doorjamb, and in particular, is directed to refurbishing a deteriorated coke oven doorjamb where the jamb face has been eroded by corrosive tars, flames, and fumes associated with the hostile coking environment.

A typical enclosure for a coke oven battery incorporates a line of spaced apart heavy steel buckstays tied across the top and bottom of the battery with spring loaded tie rods. The buckstay arrangement supports the refractory brickwork that forms a plurality of parallel coking ovens that extend along the length of the battery. Each oven includes two door openings located opposite each other at the coke side and the pusher side of the oven, and the door openings include a one-piece doorjamb equipped with hooks to fasten the coke oven doors.

Modern self-sealing coke oven doors include spring loaded seal arrangements that depend on metal to metal contact between the door and a continuous machined surface that extends alone the cast iron, or ductile-iron, doorjamb. These door seal mechanisms eventually fail because they are continuously exposed to the high temperatures required to coke coal, up to about 1535° C., as well as to volatile matter, tars and fume produced by coking coal. The tars seep out onto the machined face of the doorjamb where they build up into a thick corrosive coating that erodes the highly machined surface and reduces door seal effectiveness.

Coke oven batteries are subjected to very rigid air quality standards set by both OSHA and the EPA. When coke doors begin to leak it is necessary for the operators to immediately repair the doors in order to maintain good air quality levels. In instances where the leakage is caused by an eroded doorjamb, the jamb is replaced with a new doorjamb. Oven door expense has always been a large factor in the over-all cost of coke oven maintenance. Despite this fact, replacing eroded cast iron doorjambs is an accepted maintenance procedure within the industry, and it is a major contributor to maintenance expense. Such repair practice is both time consuming and expensive, and there is no known alternative procedure for repairing eroded doorjambs. In other words, there has existed a longstanding need in the art for a method and/or apparatus to effectively repair eroded coke oven doorjambs at a low cost.

SUMMARY OF THE INVENTION

It is therefore an object of this invention to improve maintenance procedures repairing eroded coke oven doorjambs.

It is a further object of this invention to provide apparatus for refurbishing an eroded coke oven doorjamb.

It is still a further object of this invention to repair a leaking coke oven door having an eroded doorjamb.

In satisfaction of the foregoing objects and advantages, the present invention provides a method and apparatus for refurbishing eroded portions in coke oven doorjambs including refurbishing apparatus having a framework attached to the coke oven structure adjacent the doorjamb. The framework supports a carriage that is simultaneously moveable in an "X" axis direction and a "Y" axis direction within the boundary so that a machine-cutting tool, attached to the carriage, call be moved from one position directly to another position within the framework boundary. The machine-cutting tool is positioned to make cutting passes along new metal that is fused into the eroded portions of the coke oven doorjamb.

DETAILED DESCRIPTION OF THE PREFERRED EMBODIMENT

Coke oven doorjambs are subjected to harsh, noxious conditions that tend to erode the machined surface of the doorjamb face. During normal coking operations, corrosive tars, flames, and fume, produced by coking coal, attack the highly machined jamb face that cooperates with the door seal to prevent coking gas leakage into the environment. The tars and corrosive compounds seep onto the machined jamb face where they tend to build up into a thick corrosive coating that erodes the machined sealing surface, thereby reducing door seal effectiveness.

Numerous past patents teach an assortment of methods and apparatus that scrape tar and carbon buildup from the jamb face. For example, U.S. Pat. No. 4,375,389, granted to Lindgern, discloses a coke oven door cleaner that includes a cutter tool to remove carbon deposits from a doorjamb. In the same manner, U.S. Pat. No. 4,300,257, granted to Ibe, et al., teaches scrapper apparatus for removing tar and other deposits from a coke oven door. These patents, together with additional prior teaching known to the inventor, fail to recognize the corrosive nature of coking operations and its deleterious effect on cast iron doorjambs. In addition, the known prior patents lack any teaching with respect to refurbishing eroded doorjambs. This lack of teaching is emphasized by industry wide, accepted doorjamb repair practice that teaches replacing eroded or worn jambs with new coke oven doorjambs.

Figure 1:
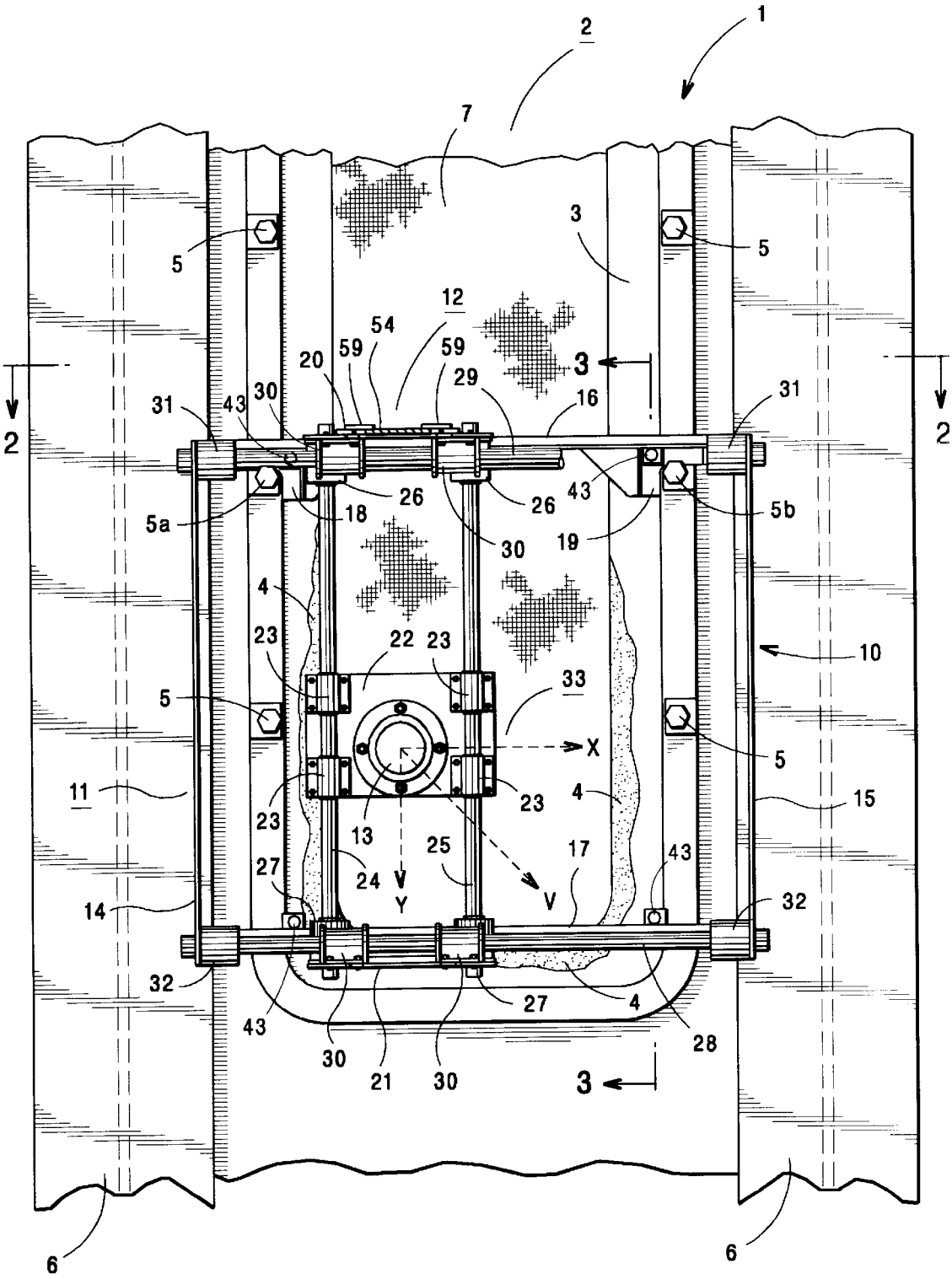
FIG. 1 is a front elevation view showing an eroded coke oven doorjamb and the preferred apparatus of the present invention.
Figure 2:
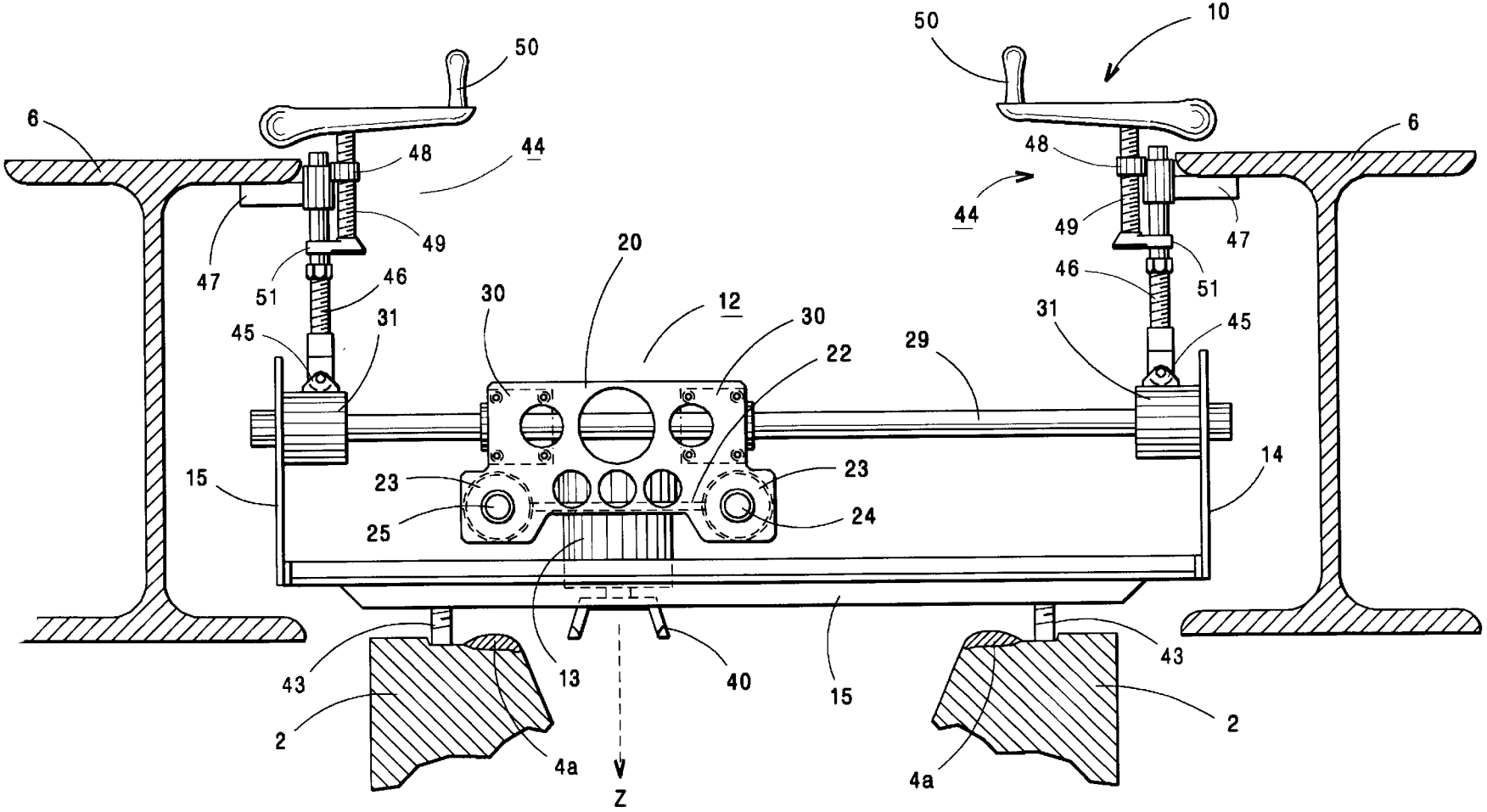
FIG. 2 is a cross-section view taken along the lines 2—2 of FIG. 1.
Figure 3:
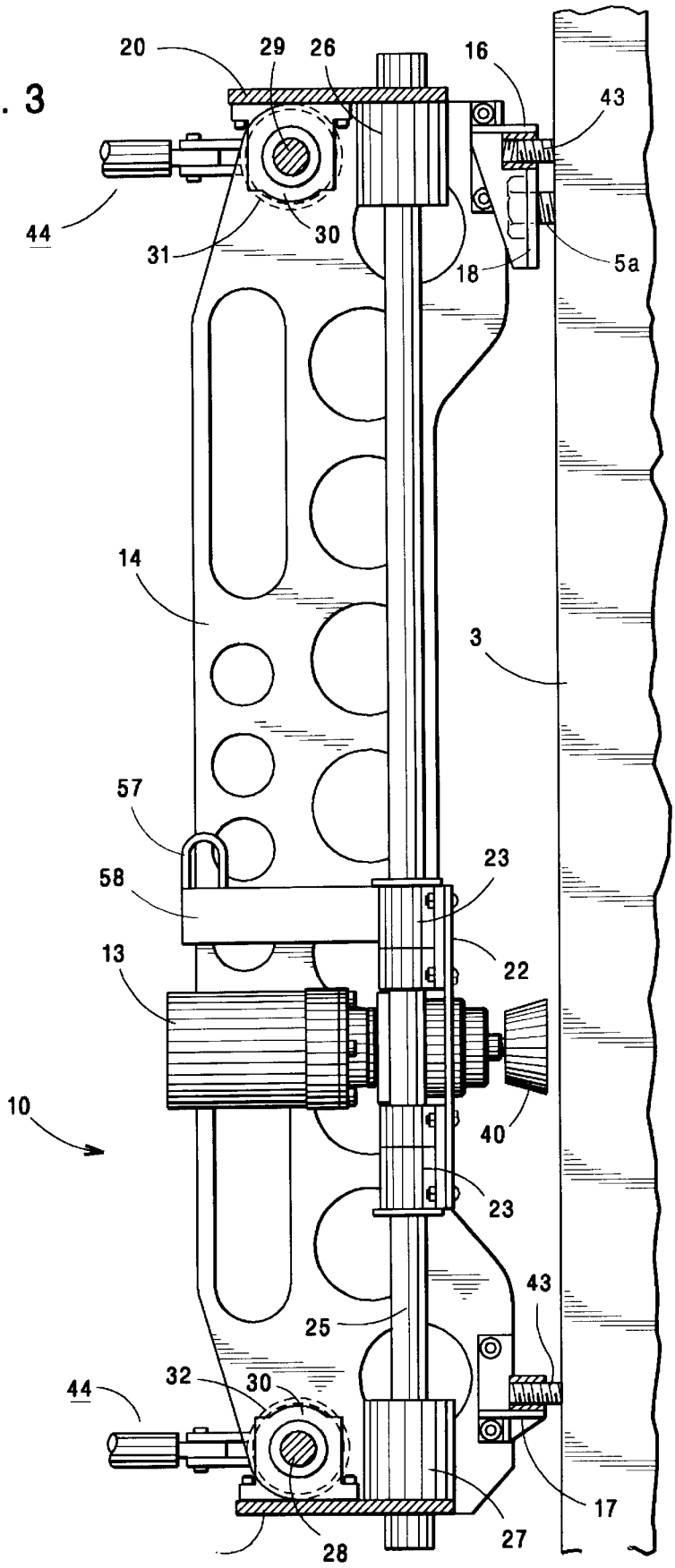
FIG. 3 is a cross-section view taken along the lines 3—3 of FIG. 1.

Referring to the drawing FIGS. 1–3 of the preferred embodiment, the refurbishing apparatus 10 is shown attached to a coke oven 1 adjacent an open coke oven doorway 2 where the coke oven doorjamb 3 has an eroded portion 4. The refurbishing apparatus 10 is suspended from door lugs 5 that are used in combination with other door locking mechanisms (not shown) to fasten a coke oven door, and the refurbishing apparatus is clamped between buckstays 6 and the door jamb 3. A heat insulating mat 7 is inserted into the open coke oven doorway to protect workers from high temperatures that normally radiate outward from the open coke oven.

The doorjamb refurbishing apparatus includes a framework 11 that supports a carriage arrangement 12 that carries a machine tool 13 for machine-cutting a face portion of the doorjamb that is being refurbished. The framework comprises a first side member 14 spaced apart from a second side member and 15 and top and bottom cross piece members 16 and 17 extending between the side members 14 and 15. The top cross piece member 16 includes at least two adjustable hanger hooks 18 and 19 that are spaced apart by the operators to accommodate any variation in distance between selected door lugs 5 that extend outward along opposite sides of the doorjamb 3. For example, as shown in FIG. 1, the center-to-center distance between hanger hooks 18 and 19 is shown adjusted to approximate the distance between opposed door lugs 5*a* and 5*b*, and the refurbishing apparatus is suspended from the door lugs 5*a* and 5*b* by hanger hooks 18 and 19. This places the refurbishing apparatus, and in particular machine tool 13, adjacent an eroded jamb portion 4 that is being refurbished.

The carriage arrangement 12 includes a top carriage plate 20, a bottom carriage plate 21, and a machine tool carrying plate 22 moveably attached, and positioned between the top and bottom carriage plates 20 and 21. The machine tool carrying plate 22 is fastened to a linear motion device that provides carriage movement along the "Y" axis of the refurbishing apparatus. In the preferred embodiment the linear motion device includes bearings 23 that slidably engage linear shafts 24 and 25 that extend between the top and bottom carriage plates 20 and 21. The bearings 23 are fastened to the carrying plate 22 and the shafts 24 and 25 are mounted within shaft supports 26 and 27 that are attached to the top and bottom carriage plates 20 and 21.

A second linear motion device having shafts 28 and 29, that slidably engage bearings 30, extend between side members 14 and 15 to enable the machine tool carrying plate 22 to move along the "X" axis of the refurbishing apparatus. The bearings 30 are fastened to the top and bottom carriage plates 20 and 21 to slidably engage their respective horizontal shafts 28 and 29, and the shafts 28 and 29 are mounted within shaft supports 31 and 32 that are attached to the side members 14 and 15.

As illustrated by the vector diagram 33 in FIG. 1, the "X-Y" bearing arrangement provides the means to push or pull the machine tool carrying plate along any angle, shown as vector "V" in the diagram, within the bounds of the framework 11. This enables operators to move the metal cutting tool 13 in any straight line direction toward a selected eroded portion being resurfaced, and makes it possible for operators to quickly and efficiently position the machine tool 13 adjacent a selected jamb portion.

Figure 4:
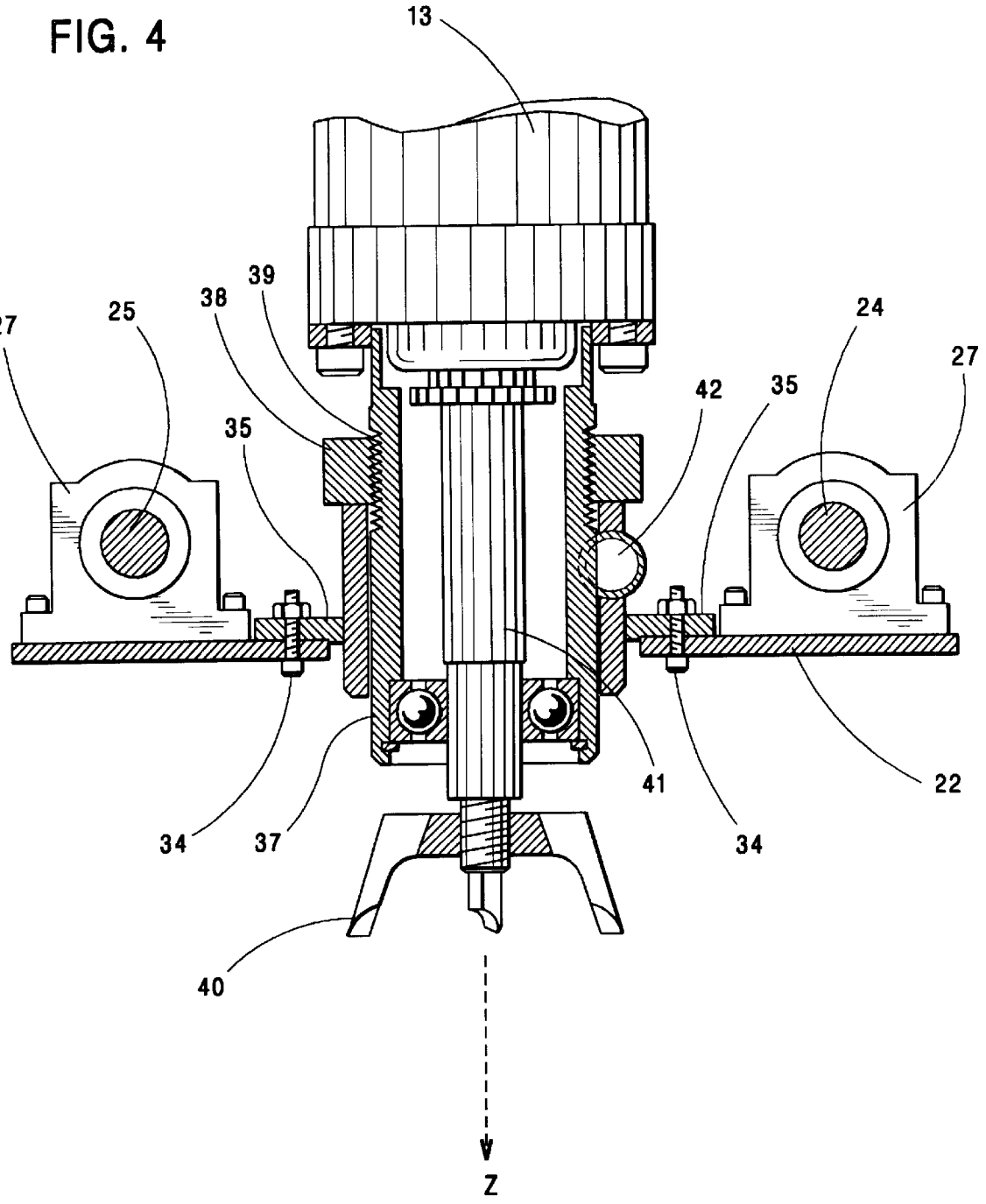
FIG. 4 is a cross-section view taken through the machine tool of the preferred embodiment of the invention.

Referring to FIG. 4, machine tool 13 is attached to the machine tool carrying plate 22 by fasteners 34 that extend through the plate 22 and a flange 35 that extends outward from the machine tool. Flange 35 is attached to one end portion of a tube 36 that encircles the chuck sleeve 37 of the machine tool, and a threaded collar 38 is positioned adjacent the opposite end of tube 36 to engage a threaded portion 39 that extends along chuck sleeve 37. A machine tool bit 40 is fastened to the drive shaft 41 of the machine tool 13, and rotation of the threaded collar 38, in either a clockwise or counterclockwise direction, moves the tool bit 40 along the "Z" axis in a direction toward or away from the doorjamb. A threaded pinch lock 42, or any other equivalent lock arrangement well known in the art, is provided to lock the chuck sleeve 37 to tube 36 at a selected position along the "Z" axis. This prevents the tool bit from moving along the axis "Z" during machining of the doorjamb face Referring again to FIGS. 1–3, the framework 11 includes adjustment blocks 43 threaded into the top and bottom members 16 and 17, and compression clamps 44 pivotally attached to the horizontal shaft supports 31 and 32. The compression clamp is similar to a pipe clamp arrangement and each clamp includes a rod 46 pivotally attached by a clevis 45 to its respective shaft support, either 31 or 32. Rod 46 slidably engages a clamp jaw 47 arrangement that is positioned against a buckstay 6, and the clamp jaw includes a threaded hub 48 that engages a threaded shaft 49 having a crank handle 50 at one end and a sliding yoke 51 that engages rod 46. Rotation of the crank handle will either increase or decrease the clamping force between clamp jaw 47 bearing against the buckstay and the adjustment blocks 43 bearing against the doorjamb face.

The adjustment blocks 43, and compression clamps 44, cooperate to clamp and plumb the refurbishing apparatus to the face of the doorjamb. For example, as more clearly shown in FIGS. 2 and 3, after the refurbishing apparatus 10 is suspended by the hanger hooks 18 and 19 from the door lugs 5*a* and 5*b*, the four adjustment blocks 43 and 44 are individually rotated to engage the doorjamb. Blocks 43 are carefully adjusted to plumb the refurbishing apparatus with the doorjamb face so that the tool bit 40 will travel in a plane parallel to the jamb face during machining operations. The crank handles 50 of clamps 44 are rotated to clamp the plumbed refurbishing apparatus between the jamb face 3 and adjacent buckstays 6.

Figure 5:
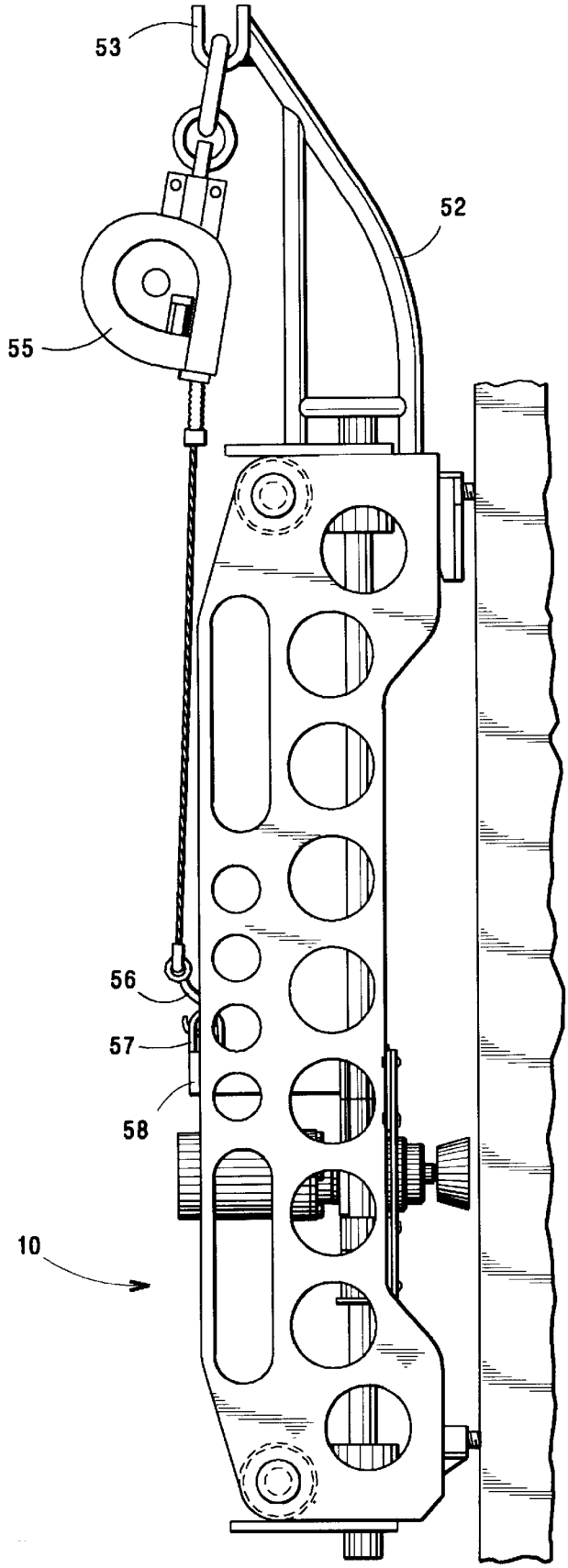
FIG. 5 is a side elevation of the preferred apparatus showing a counter balance arrangement.

Balance apparatus may be provided to furnish a counter weight arrangement to assist the workers machine cutting a doorjamb face by supporting the weight of the machine tool 13 during the cutting operation. Referring to FIG. 5 of the drawings, the balance apparatus comprises a main support beam 52 having a shoe plate 54 (Shown in FIG. 1) that fits into a shoe mount provided by plates 59 attached to the top member 16 of the framework 11. Referring again to FIG. 5, the main support beam includes a hook end 53 for attaching a balance mechanism 55, and the retractable cable end 56 of the balance is attached to a hasp 57 fastened to a bar 58 that extends outward from the machine tool carrying plate 22.

It is apparent from the lack of teaching that there exists a need within the art for a method of repairing eroded coke oven doorjambs that does not require replacement with a new doorjamb. It has been discovered that the following method can effectively and efficiently repair the eroded doorjamb. When it is determined that a coke oven doorjamb has eroded to a point where the door seals no longer effectively prevent noxious gases from escaping into the atmosphere, the coke oven door is removed from the eroded doorjamb. An insulation bat 2 is inserted into the open oven doorway as shown in FIG. 1. and the eroded portions 4 of the door jam are then cleaned to remove the tars and corrosive compounds that have built up on the highly machined sealing surface of the doorjamb face 3. In the preferred method, the jamb face is grit blasted to mechanically remove carbon and tar deposits from the jamb face. However, any equivalent method, including chemical treatment, may be used to remove carbon and tar deposits from the jamb face without departing from the scope of this invention.

New metal is fused into the eroded portions 4 by arc welding or the like, such as a wire feed welder for example. Because coke oven doorjambs are made of cast iron, (NI-ROD 55) rod, wire, or the like is used to resurface the eroded portions of the jamb. The new metal 4*a* is built up to a thickness that extends past the finished face surface of the jamb as illustrated in FIG. 2, and the excess metal is later machine cut to a finish surface.

After the new metal buildup is fused into the eroded doorjamb portions, the refurbishing apparatus is plumbed to the doorjamb face and clamped into position adjacent the eroded portions that are being refurbished. The machine tool is adjusted along the "Z" axis and the carriage is moved along any selected vector "V" to make successive cutting passes and "Z" axis adjustments until the new metal is resurfaced to a selected cutting depth that coincides with the existing surface of the doorjamb face.

While this invention has been described as having a preferred embodiment, it is understood that it is capable of further modifications, uses, and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims.

I claim:

1. Refurbishing apparatus for resurfacing a doorjamb, the refurbishing apparatus comprising:

a) a framework defining a boundary;

b) a clamp for attaching said framework adjacent the doorjamb;

c) a carriage supported by said framework, said carriage simultaneously moveable along an "X" axis and a "Y" axis within said boundary defined by said framework so that said carriage travels along a vector from said "X" and "Y" axis directly to a selected location within said boundary; and d) a machine tool fastened to said carriage so that said machine tool is carried by said carriage directly to said selected location within said boundary.

2. The apparatus recited in claim 1 wherein said machine tool is a cutting tool having a bit movable along a "Z" axis toward or away from the doorjamb so that said bit can be adjusted along said "Z" axis to make a cutting pass that removes doorjamb material when said tool bit is moved within said boundary.

3. The apparatus recited in claim 1 wherein said carriage includes:

a) a top carriage plate;

b) a bottom carriage plate;

c) a carrying plate positioned between said top plate and said bottom plate, said carrying plate including;

i) fasteners to attach said machine tool, ii) at least one bearing slidably attached to at least one rod extending between said top carriage plate and said bottom carriage plate so that said carrying plate can move along said "Y" axis between said top carriage plate and said bottom carriage plate, and iii) at least one bearing slidably attached to at least one rod extending between a first side member of said framework and a second side member of said framework so that said carriage can move along said "X" axis between said first side member and said second side member.

4. The apparatus recited in claim 1 wherein said clamp is a compression clamp positioned between a structure and said framework, said compression clamp being extendable to force said framework against the doorjamb.

5. The apparatus recited in claim 1 wherein said framework includes adjustment to plumb said refurbishing apparatus to the doorjamb.

6. The apparatus recited in claim 1 wherein said framework includes a balance apparatus attached to said carriage, said balance apparatus having a counter weight mechanism to support said carriage and facilitate movement of said carriage within said boundary.

7. The apparatus recited in claim 2 wherein the doorjamb is a cast iron coke oven doorjamb and said bit removes doorjamb metal when said bit is moved in said cutting pass within said boundary.

8. Apparatus for refurbishing eroded portions in coke oven doorjambs including:

a) a framework attached to the coke oven structure adjacent the doorjamb;

b) a carriage that is simultaneously moveable along an "X" axis and a "Y" axis within a boundary defined by said framework so that a machine tool attached to said carriage can be moved from one position directly to another position along a vector from said "X" and "Y" axis within said boundary.

9. The apparatus recited in claim 8 wherein said carriage includes:

a) a top carriage plate, b) a bottom carriage plate;

c) a carrying plate positioned between said top plate and said bottom plate, said carrying plate including;

i) fasteners to attach said machine tool, ii) at least one bearing slidably attached to at least one rod extending between said top carriage plate and said bottom carriage plate so that said carrying plate can move along said "Y" axis between said top carriage plate and said bottom carriage plate, and iii) at least one bearing slidably attached to at least one rod extending between a first side member of said framework and a second side member of said framework so that said carriage can move along said "X" axis between said first side member and said second side member.

* * * * *